US006666777B1

(12) United States Patent
Lamkin et al.

(10) Patent No.: US 6,666,777 B1
(45) Date of Patent: Dec. 23, 2003

(54) PARTIAL CORD GOLF GRIP AND METHOD OF MAKING SAME

(75) Inventors: Robert E. Lamkin, Bonita, CA (US); Robert J. Lamkin, Coronado, CA (US)

(73) Assignee: Lamkin Corp., San Diego, CA (US)

( * ) Notice: Subject to any disclaimer, the term of this patent is extended or adjusted under 35 U.S.C. 154(b) by 0 days.

(21) Appl. No.: 10/232,779

(22) Filed: Aug. 28, 2002

(51) Int. Cl.[7] ..... A63B 53/14

(52) U.S. Cl. ..... 473/300

(58) Field of Search ..... 473/201, 203, 473/300, 301, 302, 303; D21/759, 758, 756; 74/551.9; 81/489; 280/821

(56) References Cited

U.S. PATENT DOCUMENTS

| | | | | |
|---|---|---|---|---|
| 1,096,264 | A | 5/1914 | Palmer | |
| 1,587,082 | A | 6/1926 | Mattern | |
| 1,604,696 | A | 10/1926 | Jordy | |
| 2,115,119 | A | 4/1938 | Park | 273/81 |
| 2,446,622 | A | 8/1948 | Turner | 69/21 |
| 2,663,663 | A | 12/1953 | Weltman et al. | 154/121 |
| 2,865,635 | A | 12/1958 | Jessen | 273/35 |
| D232,566 | S | 8/1974 | Spencer | D21/2 |
| 4,000,903 | A | 1/1977 | Swanson | 273/166 |
| 4,308,762 | A | 1/1982 | Jannard | 74/551.9 |
| 4,376,536 | A | 3/1983 | Martin | 273/81.4 |
| 4,552,713 | A | 11/1985 | Cavicchioli | 264/162 |
| D284,298 | S | 6/1986 | Kobayashi | D21/222 |
| 4,819,939 | A | 4/1989 | Kobayashi | 273/81 R |
| 4,919,420 | A | 4/1990 | Sato | 273/81 B |
| 4,974,286 | A | 12/1990 | Stowell et al. | 16/111 R |
| 4,974,846 | A | 12/1990 | Fenton | 273/81 B |
| D321,233 | S | 10/1991 | Fenton | D21/222 |
| 5,087,042 | A | 2/1992 | Solheim | 273/81 B |
| D333,333 | S | 2/1993 | Solheim | D21/222 |
| 5,248,141 | A | 9/1993 | Kelly | 273/81 B |
| 5,261,665 | A | 11/1993 | Downey | 273/81 B |
| D345,192 | S | 3/1994 | Solheim | D21/222 |
| 5,322,290 | A | 6/1994 | Minami | 273/187.5 |
| 5,348,303 | A | 9/1994 | Swissheim | 273/187.5 |
| D357,295 | S | 4/1995 | Solheim | D21/222 |
| 5,511,790 | A | 4/1996 | Duran | 473/201 |
| D376,400 | S | 12/1996 | Nakazaki | D21/222 |
| D391,330 | S | 2/1998 | Solheim et al. | D21/222 |
| 5,795,242 | A | 8/1998 | Ree | 473/303 |
| 6,234,920 | B1 | 5/2001 | Wang | 473/523 |
| 2001/0046905 | A1 | 11/2001 | Huang | 473/300 |
| 2001/0055994 | A1 | 12/2001 | Kwitek | 473/300 |
| 2002/0061787 | A1 | 5/2002 | Huang | 473/300 |

FOREIGN PATENT DOCUMENTS

| | | |
|---|---|---|
| JP | 51-49174 | 4/1976 |
| JP | 53-44525 | 4/1976 |

*Primary Examiner*—Stephen Blau
(74) *Attorney, Agent, or Firm*—Dorsey & Whitney LLP

(57) ABSTRACT

A golf club grip is composed of an elastomeric material formed into a tubular form adapted to be received on the butt end of a golf club shaft with the grip having an upper semi-cylindrical portion of rubber material with cork particles disbursed therein and with a lower semi-cylindrical portion of the grip having the tip end of the same material as the upper semi-cylindrical portion of the grip and with the butt end of the lower semi-cylindrical portion having exposed cord for enhanced friction between the grip and a user's hands. A compression molding process is described for forming the grip from component strips and pieces of an elastomeric material.

6 Claims, 5 Drawing Sheets

PARTIAL CORD GOLF GRIP AND METHOD OF MAKING SAME

BACKGROUND OF THE INVENTION

1. Field of the Invention

A grip for a golf club is made from an elastomeric material in a compression molding process wherein strips of the elastomeric material are placed in a compression mold around a mandrel. One of the strips, positioned at a location to form a portion of the length of the grip only on the undersurface of the grip at the butt end thereof, has exposed cords or fibers to improve gripping at that location of the grip. The completed grip therefore comprises an elongated hollow elastomeric sleeve adapted to fit over the butt end of a golf club shaft with a portion of the undersurface of the grip adjacent to the butt end of the grip having exposed cord.

2. Description of the Relevant Art

Grips for sporting implements such as golf clubs have taken numerous forms for many years with early grips consisting simply of a wrap of material, such as leather, in a helical pattern around the handle portion of the golf club. In recent years, the leather material has been replaced in some circumstances with polyurethane and rather than wrapping the polyurethane or leather strip of material directly onto the handle portion of the golf club, sometimes an elastomeric tubular underlisting is first mounted on the butt end of the golf club shaft so that the strip of leather or polyurethane material can be wrapped onto the underlisting.

Golf grips have evolved from the wrap type grip described above to vulcanized rubber sleeves that are simply slipped over the butt end of a golf club shaft. Such grips are still in use and typically made of one uniform elastomeric material. To improve the frictional gripping quality of the grip for the user of the club, a depressed pattern is frequently molded into the outer surface of the grip. Since the grip on a golf club must have a desired degree of torsional resistance, the elastomeric material from which the grip is made must be relatively hard which is sometimes undesirable from an aspect of obtaining the desired friction between the grip and the user's hands. Further, hard rubber materials tend to become harder and slippery over time and when the grips become wet as when a golfer is playing in the rain.

Accordingly, in order to improve the friction between the grip and a user's hand, particularly when the grip is wet, fibers or cords have been imbedded in the rubber so as to be partially exposed. U.S. Pat. No. 2,115,119 issued in 1938 to Park describes such a grip and a method of making the grip so that the cord is exposed substantially uniformly around the entire outer substantially cylindrical surface of the grip. Such grips have commonly been referred to as cord lined grips and have met with considerable success insofar as improving the friction between the grip and a user's hands. Such grips have been criticized, however, as being overly abrasive thereby causing discomfort to a user's hands and also premature wear to a golf glove used by a golfer.

It has later been recognized that the exposed cord on the top of the golf grip is not as important for friction purposes as it is along the bottom surface of the grip and accordingly a line of grips referred to as half-cord grips evolved which have exposed cord along the full length of the grip but only on the bottom half of the grip. The half-cord grips were acceptable from a friction standpoint but still were objectionable due to the abrasive nature of the cords particularly in the fingers of the hands which engaged the grip along the underside or bottom half of the grip.

The cord lined grips have been manufactured in substantially the same manner for a number of years with that process including embedding a fabric or layer of cotton fibers or the like within the rubber material from which the grip is molded and after the grip has been molded into the desired substantially cylindrical form having a hollow cavity for receiving the butt end of a golf shaft, the grip is subjected to sanding or another milling or grinding process for removing a thin outer layer of the rubber that overlies the cord until a desired amount of the cord is exposed while other portions of the cord remain imbedded in the rubber material of the grip.

While exposed cords in golf grips have provided some desirable improvements to the basic elastomeric rubber grip, both the full cord and half cord grip are still undesirable in being too abrasive on the fingers of both the left and right hands of a golfer.

Japanese Utility Model Patent No. 44525 discloses another form of a partial cord-lined grip wherein the exposed cord extends circumferentially around the entire grip but only along approximately half the length of the grip adjacent to the butt end of the grip. This grip is also not entirely satisfactory as the exposed cord on the top of the grip is not very necessary from a friction standpoint and creates unnecessary abrasion.

It is to overcome these shortcomings in the prior art that the grip of the present invention has been developed.

SUMMARY OF THE INVENTION

The present invention relates to an improved golf grip and a method of making same wherein the grip is predominately fabricated from strips of elastomeric rubber material but wherein one of the strips of material used to form the grip has a fiber or cord matting therein. The strip with the embedded fiber or cord matting is positioned in a compression mold so as to occupy only a portion of the lower half of a golf grip adjacent to the butt end of the grip as it has been determined that the most important portion of the grip providing friction between the grip and a golfer's hands is in the fingers of the left hand for a right-handed golfer. For a right-handed golfer, the left hand is placed closer to the butt end of the grip than the right hand with the fingers overlying the bottom surface of the grip and by eliminating exposed cord on the top of the grip and along the bottom of the grip adjacent to the tip end of the grip, undesired and unnecessary abrasion to a user's hand or golf glove can be avoided.

In other words, the grip of the present invention has been carefully designed to provide exposed cord only at the most important location on the grip for improving the friction between a golfer's hand and the grip thereby minimizing abrasive issues that have existed in prior art grips.

The grip of the present invention can be manufactured in a compression molding process wherein the compression mold has two heated mold halves each having a matching and confronting recess in which the rubberized strips can be placed with a mandrel that occupies space that ultimately becomes the hollow core of the grip allowing it to be slid on the butt end of a golf club shaft. When fabricating the grip, a hard rubber plug is positioned in the cavity of the lower mold half adjacent to the butt end of the cavity. The cavity opens through the butt end of the mold to allow an assembly pin to retain the plug in desired alignment with the mandrel.

Before placing the mandrel in the cavity with the plug thereon, two strips of elastomeric material are laid in the lower mold half with the strip of material adjacent the tip end of the cavity being simply an elastomeric rubber material having a composition to be described in detail later and the strip of material adjacent the butt end of the cavity being an elastomeric rubber material having a fiber or cord fabric embedded therein. The strips of material placed in the lower half of the mold are preferably of substantially the same length even though variations in their length could be provided as desired. After the strips of material have been positioned in the lower mold half, the mandrel with the rubber plug mounted thereon is placed in the cavity in the lower mold half on top of the strips of material. Subsequently, an elongated strip of elastomeric rubber material identical to that of the strip adjacent the tip end of the cavity but having an overall length approaching that of the completed grip is laid on top of the mandrel. Finally, the upper half of the mold is positioned in overlying relationship with the lower half of the mold and they are compressed together and thereafter heated to a temperature sufficient to vulcanize the rubber in the cavity defined by the mold halves.

After vulcanization, the grip is removed from the cavity and de-flashed to remove excess rubber that results from the molding process. Thereafter, the substantially cylindrical outer surface of the grip is sanded or otherwise abrasively treated until the cord fabric in the rubber material adjacent the butt end of the grip on its undersurface is desirably exposed. After the sanding treatment, the outer surface of the grip is uniformly and desirably completed with cords exposed in the bottom surface of the grip adjacent its butt end where the fingers of the left hand (for a right-handed golfer) will engage the exposed cord to improve the friction between the grip and a user's hands.

In one desired embodiment of the present invention, the elastomeric rubber material used in portions of the grip has small particles of cork interspersed therein that further enhance the frictional quality of the grip.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
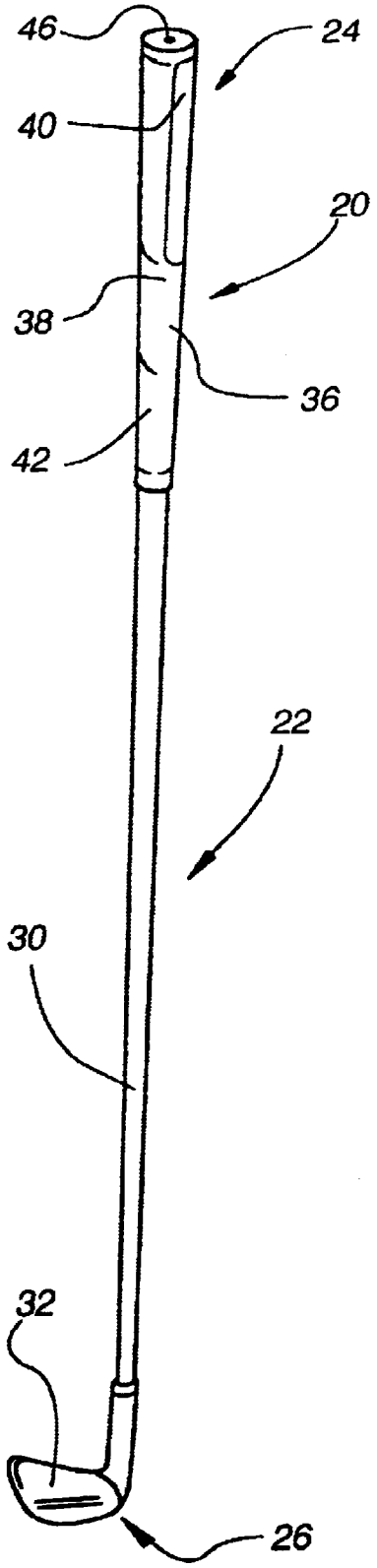
FIG. 1 is an isometric view of a golf club incorporating the grip of the present invention.
Figure 2:
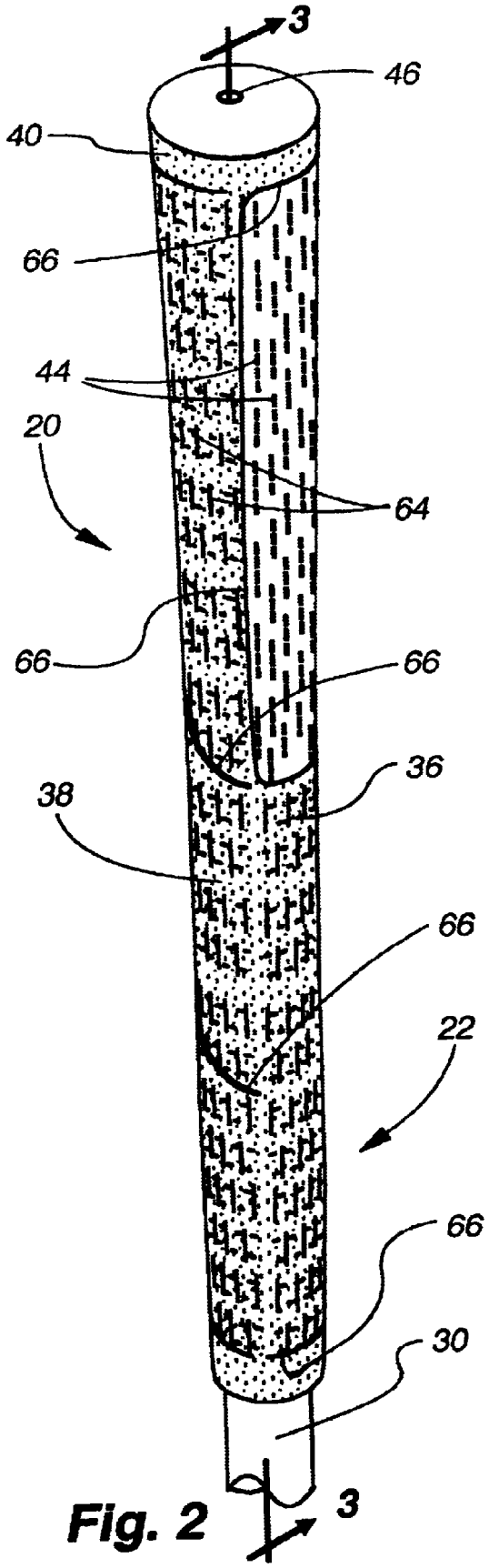
FIG. 2 is an enlarged fragmentary isometric view similar to FIG. 1 showing the grip mounted on the golf club.

The golf club grip 20 of the present invention is probably best seen in its completed form in FIGS. 1 and 2 mounted on a golf club 22. As with all golf club grips and as will be explained in more detail later, the grip is of generally cylindrical configuration while sloping or tapering slightly and conventionally from its butt end 24 to its tip end 26. The grip has an elongated cavity 28 (FIG. 3) designed in size and configuration to matingly receive the butt end of the golf club shaft 30. As can be appreciated in FIG. 1, the golf club has a golf club head 32 that forms a substantially lateral projection from the top of the golf club shaft at the tip end 26 thereof and the grip might, from an imaginary standpoint, be viewed as defining a semi-cylindrical upper half 36 that overlies the top of the golf club shaft and a semi-cylindrical lower half 38 that underlies the bottom side of the golf club shaft. As will be appreciated in FIG. 2, the top or upper semi-cylindrical half 36 of the golf club grip is uniform along the entire length of the grip whereas the semi-cylindrical half 38 of the grip has a butt end 40 that is different in texture and construction from the tip end 42 in that it has exposed cord 44 therein. The tip end of the bottom semi-cylindrical half 38 of the grip is identical in texture and material to the top semi-cylindrical half 36 of the grip but it is to be understood that the entire grip is molded into one unitary piece in a process to be described in detail hereafter. The grip further has a hard rubber plug or end cap 42 at its butt end with the plug having a vent hole 46 therethrough to facilitate mounting the grip on a golf club shaft as is well known in the trade.

Figure 3:
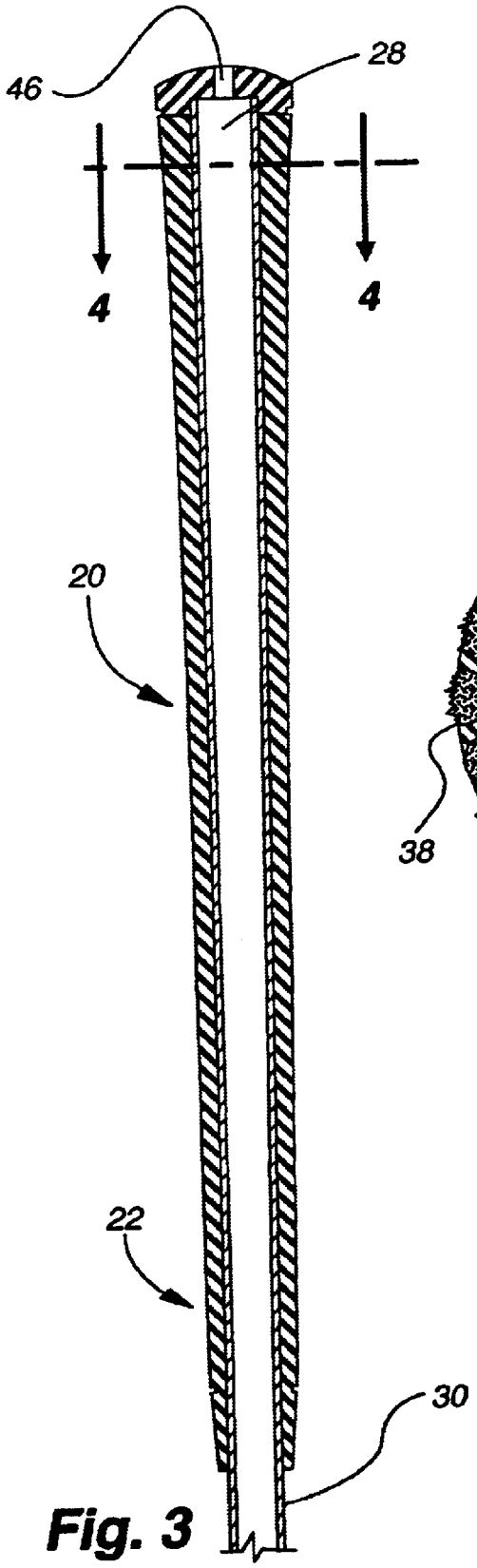
FIG. 3 is a fragmentary section taken along line 3—3 of FIG. 2.
Figure 4:
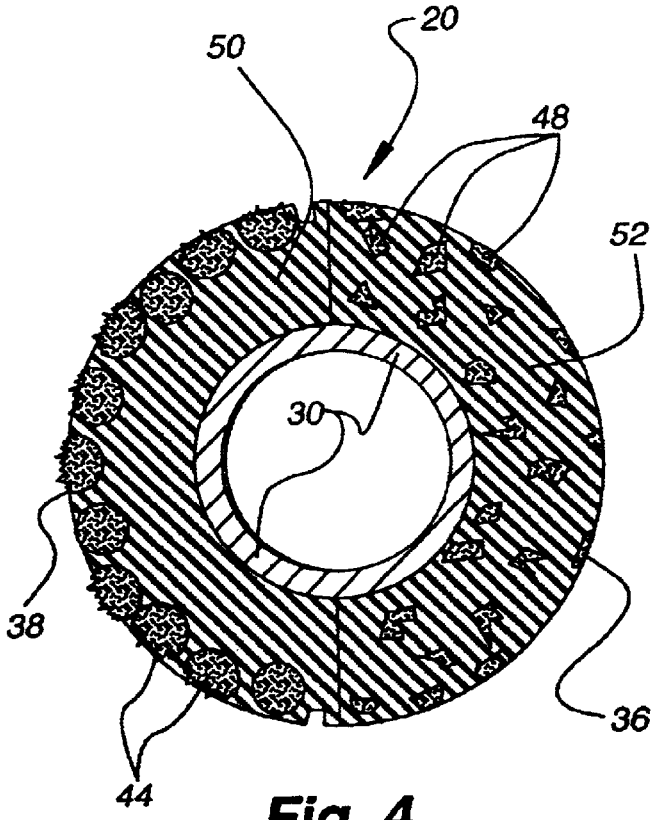
FIG. 4 is an enlarged section taken along line 4—4 of FIG. 3.

In FIG. 3, the grip can be seen in section mounted on the golf club shaft 30 with the shaft extending substantially the entire length of the grip within the elongated cavity 28 into engagement with an inner surface of the end cap 42. As is conventional, the grips are adhesively mounted on the butt end of the golf club shaft typically through use of double-faced adhesive tape that is lubricated with an evaporative material such as paint thinner or gasoline to facilitate sliding the grip onto the butt end of the shaft.

The grip 20 of the present invention is made of an elastomeric material such as a thermoset rubber but wherein the rubber used in the portion of the grip at the butt end of the lower semi-cylindrical half 38 of the grip has a fabric or cord material 44 embedded therein that is not embedded in the remainder of the grip. The remainder of the grip rather has small particles of cork 48 interspersed therein. The fabric or cord material 44 in the butt end of the lower semi-cylindrical portion 38 of the grip is partially exposed so that the cords protrude slightly above the elastomeric surface of the grip along that location. The fabric or cord material is preferably a cotton or cotton based material. The strands of cotton or similar material in the fabric or cord material extend primarily lengthwise of the grip so that where the cords are exposed through the elastomeric material, the cords run lengthwise of the grip to assist in preventing the grip from twisting in the hands of a golfer.

In the preferred embodiment of the grip 20, the butt end of the lower semi-cylindrical portion 38 of the grip having the exposed cord 44 therein extends approximately one-half the length of the grip so as to cover the lower quarter of the grip at the butt end thereof. The remainder of the grip, i.e. the top semi-cylindrical half 36 and the tip end of the lower semi-cylindrical half 38 are all the same rubber material with the chips or particles of cork 48 embedded therein. The cork also facilitates desired friction between the user's hands and the grip and has been previously used for this purpose in golf grips but not to the extent of its presence in the present grip. Preferably, the cork occupies approximately three percent of the material in the grip on a volume basis.

The material from which the upper and lower semi-cylindrical portions of the grip are made is preferably a thermoset rubber material as mentioned previously having a durometer rating in the range of 52–58 Shore A.

The aforedescribed golf club grip 20 is manufactured in a compression molding process, utilizing various component parts. The various components of the grip are illustrated in FIGS. 5–12, with FIG. 5 being a plan view of the strip of material 50 which ultimately becomes the butt end of the lower semi-cylindrical half 38 of the grip. As will be appreciated, the strip 50 is trapezoidal in configuration. In the sectional view of FIG. 7 and in FIG. 9 it will be appreciated that the cord or fabric 44 is positioned in the elastomeric rubber material adjacent to a top surface thereof, but the cord or fabric is initially completely confined within the rubber and is not visible.

Figure 6:
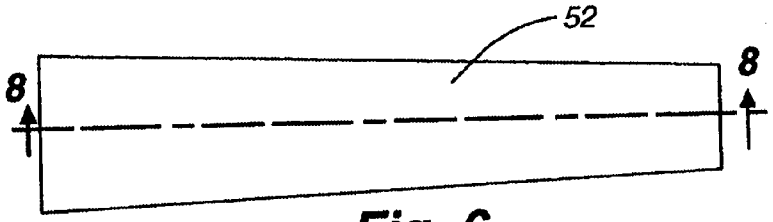
FIG. 6 is an isometric view of a second strip of elastomeric material utilized in the grip of the present invention.
Figure 8:
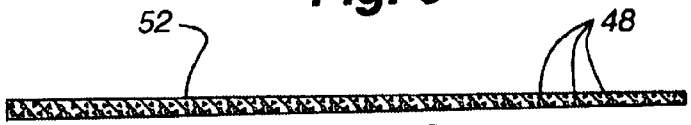
FIG. 8 is a section taken along line 8—8 of FIG. 6.
Figure 9:
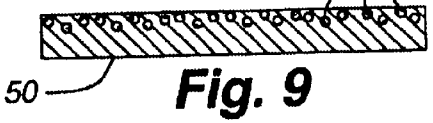
FIG. 9 is an enlarged section taken along line 9—9 of FIG. 7.
Figure 5:
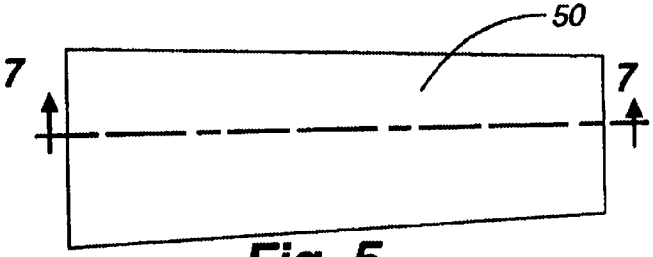
FIG. 5 is plan view of a strip of elastomeric material utilized in the grip of the present invention in which a fabric material is embedded in the elastomeric material.
Figure 7:
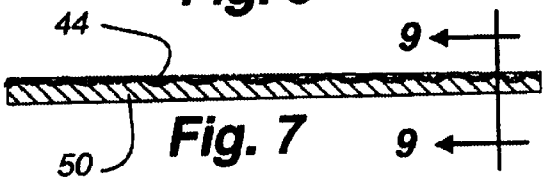
FIG. 7 is a section taken along line 7—7 of FIG. 5.

FIG. 6 is a plan view of the strip of material 52 that ultimately becomes the tip end of the lower semi-cylindrical portion 38 of the grip and it too is trapezoidal in configuration and sized so as to be a longitudinal continuation of the strip 50 shown in FIG. 5. When the strips 50 and 52 shown in FIGS. 5 and 6, respectively, are abutted in longitudinal alignment, they form a relatively large trapezoid that tapers from the butt end to the tip end of the grip inasmuch as the grip itself tapers from the butt end to the tip end as with almost all golf club grips. FIG. 8 is a cross section along the length of the strip 52 shown in FIG. 6, and as will be appreciated, the particles of cork 48 are interspersed throughout the elastomeric rubber material, even though they are not normally exposed on the top and bottom surfaces of the rubber material when the strip is placed in the mold.

Figure 10:
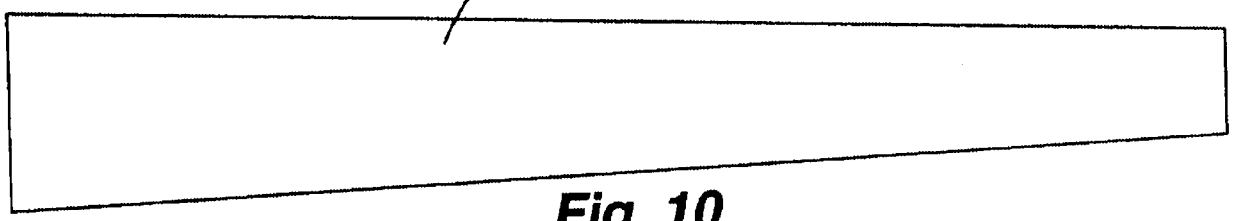
FIG. 10 is plan view of a third strip of elastomeric material utilized in the grip of the present invention.
Figure 11:
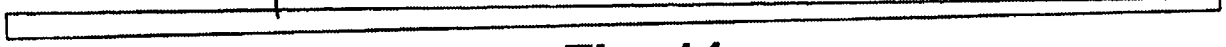
FIG. 11 is a side elevation of the strip of material shown in FIG. 10.

FIG. 10 is a plan view of a strip of material 54 that ultimately forms the upper semi-cylindrical portion 36 of the grip and this strip of material as described previously is of identical composition to the strip 52 illustrated in FIG. 6. FIG. 11 is a side elevation of the strip 54 shown in FIG. 10, and again while particles of cork 48 are interspersed throughout the strip they are not visually apparent in the flat surfaces of the strip. The strips of rubber as illustrated in FIGS. 5–12 are pre-molded in a conventional manner into the strips as illustrated or into larger sheets which are later cut into the shapes and sizes illustrated.

Figure 12:
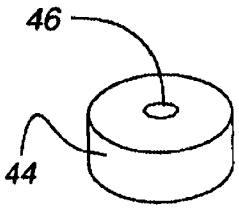
FIG. 12 is an isometric view of a plug used in the butt end of the grip of the present invention.

FIG. 12 shows the end cap 42 for the grip which is simply a hard rubber material having an axial opening therethrough which forms the vent opening 46 in the completed grip. As will be appreciated with the description of the molding process that follows, the end cap becomes integrated with the strips of material 50 and 54 shown in FIGS. 5 and 10, respectively, during the molding process so that the entire grip becomes one unified body but of different compositions at various locations in the grip.

The grip is molded in a compression mold (FIGS. 13–15) having upper and lower halves 56 and 58, respectively, with each half having a confronting face 60 in which an identically-sized recess 62 is formed. Each recess represents half of the completed grip and has a pattern formed therein which ultimately forms a desired pattern of indentations 64 (FIGS. 2 and 13) in the outer surface of the grip with the patterns typically being formed to improve the friction between the grip and the golfer's hands. Further, other lines of indentation 66 (FIG. 2) may be provided in the recesses for aesthetic purposes such as to outline the butt end of the grip in the lower semi-cylindrical portion 38 to separate it visually from the remainder of the grip.

The upper mold half 56 has alignment pins 68 protruding from its confronting face 60 at the four corners thereof, and they are adapted to be received in alignment holes 70 in the confronting face 60 of the lower mold half 58. The mold halves are mounted on upper and lower portions of a press, which has not been shown, even though a portion of a press shaft 72 is shown on the top of the upper mold half 56. It will be appreciated that the mold halves can be moved into confronting relationship by the press and retained in that relationship during a molding process.

Figure 13:
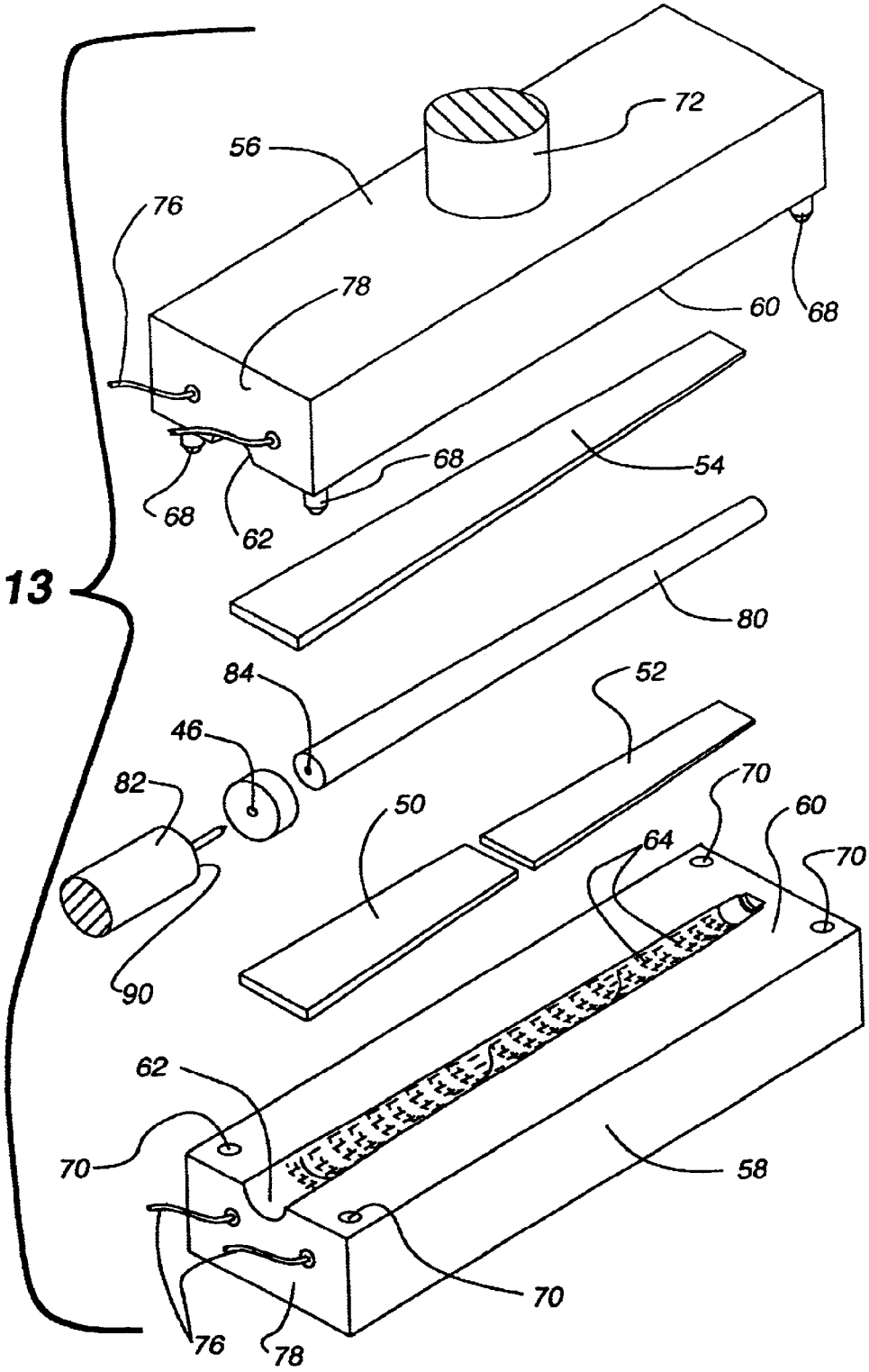
FIG. 13 is an exploded isometric view of a compression mold and mandrel utilized to form the grip of the present invention along with the components of the grip being positioned between mold halves.
Figure 14:
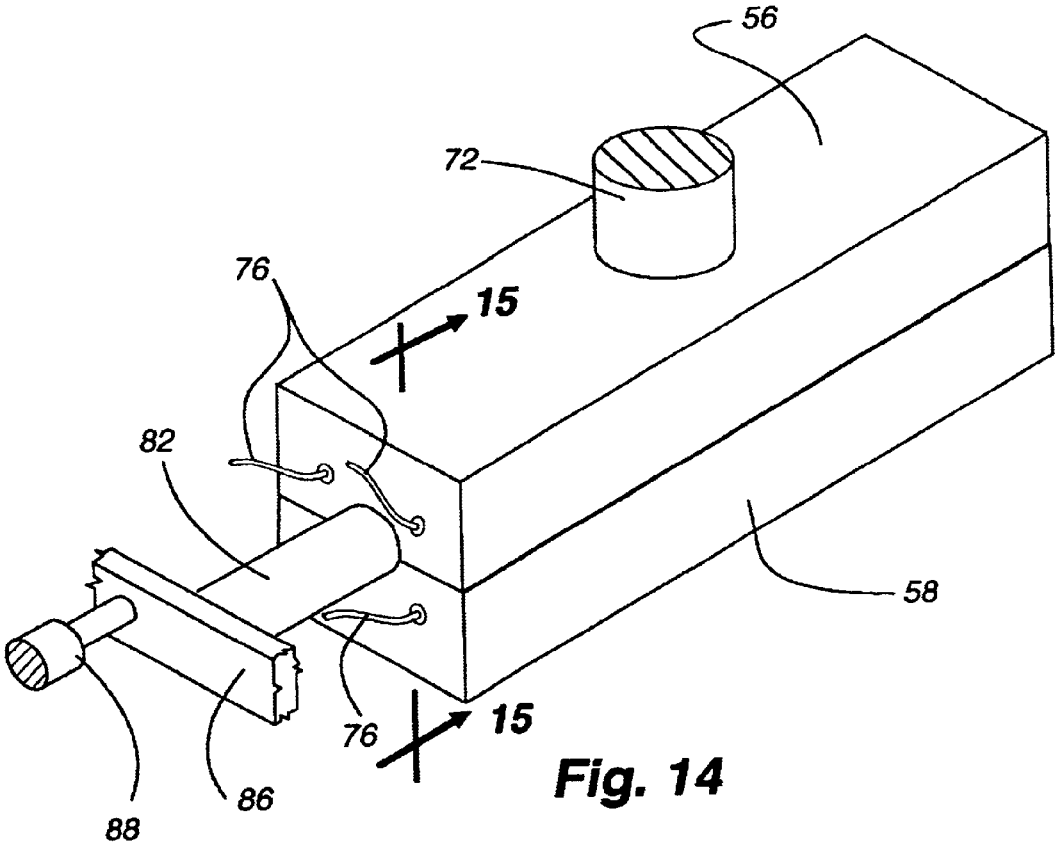
FIG. 14 is an isometric view of the mold shown in FIG. 13 with the mold being shown in a closed position for molding the grip.
Figure 15:
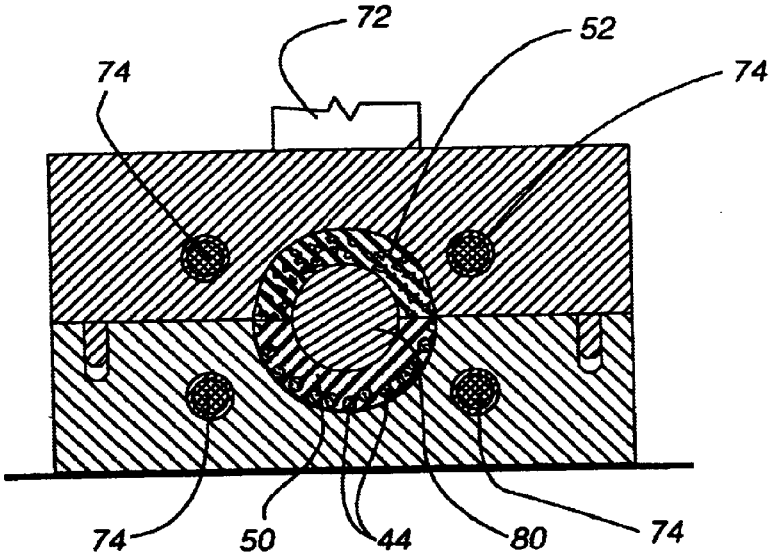
FIG. 15 is an enlarged section taken along line 15—15 of FIG. 14.

As is probably best appreciated by reference to FIG. 15, each mold half has a pair of heater elements 74 therein, with the heater elements in the disclosed mold being of a resistance type having lead wires 76 seen in FIGS. 13 and 14. The lead wires are connected to an electrical source (not shown) so that the wires can be energized to heat the mold halves which are made of a heat conductive metal material whereby the mold can be heated to a temperature sufficient to vulcanize the rubber material used in the grip.

With reference to FIG. 13, the molding process is carried out by first placing the butt and tip end strips 50 and 52, respectively, of the lower semi-cylindrical portion 38 of the grip in the recess 62 in the lower mold half 58 with the butt end of the recess 62 being defined as being adjacent to the end 78 of the mold through which the recess opens. The opposite end of the recess is closed and receives the tip end strip 52 that forms the tip end of the lower semi-cylindrical portion 38 of the grip. After the strips are laid in position within the lower half of the mold, an assembly consisting of the end cap 42 and an elongated mandrel 80, that is typically metal and conforming in size and configuration to the hollow cavity 28 to be formed in the grip, is positioned over the strips 50 and 52. The end cap is mounted on the butt end of the mandrel and an assembly pin 82 is inserted through the vent hole 46 in the end cap and into a blind axial hole 84 in the butt end of the mandrel to hold the end cap on the mandrel in a centered relationship prior to the molding process and with the end cap abutted against the adjacent end of the butt end strip 50. With the mandrel positioned over the strips 50 and 52 in the recess 62 in the lower mold half 58, the relatively long elastomeric strip 54 that forms the upper semi-cylindrical portion 36 of the grip is placed over the mandrel. Subsequently the upper mold half 56 is moved into compressive relationship with the lower mold half 58 such that the component parts of the grip and the mandrel 80 are positioned within the confronting recesses 62 of the mold halves. Of course, when the mold halves are moved into compressive relationship with each other, the alignment pins 68 are received in the alignment holes 70 so that the recesses 62 in the mold halves are properly aligned to define a cavity within the mold in which the grip is formed.

As seen in FIG. 14, the assembly pin 82 seals off the cavity defined between the mold halves at the end 78 so that the grip can be properly vulcanized under pressure within the mold. It is also anticipated that a plurality of the molds (not shown) for simultaneously making a plurality of grips can be provided in aligned, side by side relationship in which event there may be a plurality of assembly pins 82 mounted on a common bar 86 which in turn is supported by a reciprocal actuator 88 which applies pressure against the assembly pin through the bar 86 and in turn against the butt end of the end cap 42. An engaging end 90 of the assembly pin has a concave surface (not seen) which engages the end cap so that the butt end of the end cap is molded in a convex configuration.

With the cavity in the mold completely sealed off and the components of the grip in place, the resistive heaters 74 in the mold halves are energized to vulcanize the rubber, so that the component parts are molded together into one integral body. After the grip has been fully vulcanized, the mold halves 56 and 58 are separated and the grip removed from the mold with the mandrel 80 remaining within the molded body of the grip.

At this point, the entire molded body is of substantially uniform appearance but with some flashing as is normal in compression molding processes. Accordingly, the grip is conventionally de-flashed and after having been de-flashed, the outer surface of the grip is uniformly milled or sanded to remove a thin layer of rubber, and in the process, expose a thin layer of the fabric or cord 44 within the rubber material at the butt end of the lower semi-cylindrical half 38 of the grip. Since the cork 48 is interspersed throughout the elastomeric material, it too is partially exposed in the upper semi-cylindrical portion 36 of the grip and the tip end of the lower semi-cylindrical portion 38 of the grip.

The milling or sanding of the surface of the grip to expose a portion of the fabric or cord embedded in the elastomeric material is well known in the art as is evidenced by the aforenoted U.S. Pat. No. 2,115,119 to Park. Accordingly, a detailed description of that process is not deemed necessary.

For ornamental or decorative purposes and prior to milling or sanding the surface of the grip, paint may be applied over the outer surface of the grip which is absorbed in any indentations 64 or 66 formed in the outer surface of the grip during the molding process by the patterned surfaces in the recesses 62 in the mold halves. Most of the paint is removed during the milling or sanding process leaving only paint that is in the bottoms of any indentations formed in the outer surface of the grip.

By following the afore-noted process, a grip 20 is formed which is uniform in external appearance and texture along the upper semi-cylindrical portion 36 of the grip and along the lower semi-cylindrical portion 38 of the grip at the tip end thereof with cord 44 being exposed at the butt end of the lower semi-cylindrical portion 38 of the grip. The cord is therefore exposed to the fingers of the left hand (for a right-handed golfer) which has been determined to be the most critical area where friction is desired between a golfer's hands and the grip. By limiting the exposed cord to this location of the grip, unnecessary abrasion of a golfer's hands or premature wear of a golf glove is minimized without sacrificing torsional control of the golf club which is obtained through the grip and primarily through the fingers in the left hand of the grip.

Although the present invention has been described with a certain degree of particularity, it is understood the present disclosure has been made by way of example, and changes in detail or structure may be made without departing from the spirit of the invention as defined in the appended claims.

What is claimed is:

1. A golf club grip comprising an elongated elastomeric substantially cylindrical body having a hollow core for receipt of a golf club shaft, a closed butt end and an open tip end through which the golf club shaft can be inserted into the hollow core of the grip, said cylindrical body defining a substantially semi-cylindrical upper portion adapted to overlie a top surface of a golf club shaft and a substantially semi-cylindrical lower portion adapted to underlie a bottom surface of a golf club shaft, said upper and lower portions being unified in an integral body, said lower portion having two zones with one zone being adjacent to the butt end of the grip and the other zone being adjacent to the tip end of the grip, said one zone having partially exposed cord therein and being the only portion of the grip where fibers are embedded in the elastomeric material and are exposed.

2. The grip of claim 1 wherein said one zone and said other zone are of substantially the same length.

3. The grip of claim 1 wherein said elastomeric material is predominantly a thermoset rubber.

4. The grip of claim 3 wherein said thermoset rubber includes particles of cork interspersed therein.

5. The grip of claim 4 wherein said cork constitutes approximately 3% by volume of the grip.

6. The grip of claim 1 wherein said cord is cotton based.

* * * * *